US006114928A

United States Patent [19]

Smith

[11] Patent Number: 6,114,928

[45] Date of Patent: Sep. 5, 2000

[54] MOUNTING ASSEMBLIES FOR TUBULAR MEMBERS USED IN RF FILTERS

[76] Inventor: Patrick Smith, 7566 Morningside Dr., Northfield Center, Ohio 44067

[21] Appl. No.: 08/967,003

[22] Filed: Nov. 10, 1997

[51] Int. Cl.[7] ..... H01P 1/20; H01P 1/205; H01P 7/00

[52] U.S. Cl. ..... 333/202; 333/203; 333/219; 333/99 R

[58] Field of Search ..... 333/202, 203, 333/219, 227, 230, 99 R, 208, 212, 219.1, 206, 222

[56] References Cited

U.S. PATENT DOCUMENTS 5,347,246 9/1994 Bellows et al. ..... 333/219.1
5,428,325 6/1995 Jachowski et al. ..... 333/203
5,612,655 3/1997 Stronks et al. ..... 333/202

FOREIGN PATENT DOCUMENTS 0 533 394 A2 3/1993 European Pat. Off. ..... 333/203

*Primary Examiner*—Robert Pascal
*Assistant Examiner*—Barbara Summons

[57] ABSTRACT

A tubular assembly for use in an RF filter having an internal cavity. The tubular assembly includes a hollow tube and a flare positioned inside the hollow tube for mounting the hollow tube onto the filter housing. The flare includes at least two engagement surface portions which engage the inner wall of the hollow tube. During assembly, the flare engagement surface portions expand thereby locking the hollow tube on the filter housing.

34 Claims, 5 Drawing Sheets

4/5

MOUNTING ASSEMBLIES FOR TUBULAR MEMBERS USED IN RF FILTERS

BACKGROUND OF THE INVENTION

RF filters are used in many high frequency (RF and microwave) electronic applications. For example, in cellular telephone communications, users within each operating cell are assigned a unique operating frequency within the frequency band designated for cellular communications. Therefore, each time a cellular user places or receives a call, that call will be assigned to one of the allocated frequencies. The channel in the cell repeater station that is relaying the telephone call must be tuned to the specific frequency of the call.

A typical cellular communications frequency band spans 869 MHz–894 MHz, with channel frequencies spaced 630 kHz apart (Advanced Mobile Phone Service. (AMPS) frequency standard). The cellular telephone service provider will assign particular channel frequencies to different cell sites within its service area. For example, a typical cell site may have 24 channel frequencies assigned to it. Each of these channels has a repeater transmitter that operates at a channel frequency.

Typically, each channel in the cell station has a narrow bandpass RF filter at the RF output of the transmitter that must be tuned to the channel frequency. A narrow bandpass filter ensures that only signals on the frequency assigned to that channel are transmitted.

A conventional RF filter assembly employs tubular resonators secured in cavities of the filter housing. Decoupling rods may also be provided between resonators to provide an enhanced resonator decoupling effect. Decoupling rods allow the resonators to be placed closer together thereby reducing the size of the filter assembly.

The problem with making many conventional filter assemblies is that the tubular resonators and decoupling rods are typically machined and fabricated at substantial expense. Many are formed with an integral means for mounting the resonator or decoupling rod. Thus, filter assemblies having typical machined resonators and decouplers are very expensive to manufacture.

It would be an advantage to provide a resonator filter assembly which uses conventionally formed or drawn tubing as the resonators as well as decoupling rods. It would also be desirable to provide a standard, flexible method of mounting resonators and decoupling rods to the filter housing.

SUMMARY OF THE INVENTION

In accordance with the present invention, an RF filter assembly comprises a filter housing defining a cavity, a tubular assembly mounted in the housing, and a mounting member for firmly locking the tubular assembly against the housing.

The tubular assembly comprises at least one hollow tube having an inner wall defining an interior of uniform diameter and having a circular base and a flare positioned within the interior of the hollow tube. The flare has at least two spaced engagement surface portions and has means receiving the mounting member such that when the tubular assembly is initially mounted in the housing, the flare engagement surface portions are expanded by the mounting member into locking engagement with the inner wall of the hollow tube and the circular base of the hollow tube is drawn into firm engagement with the filter housing. The hollow tube may be a resonator mounted at one end by a flare or may be a decoupling rod mounted to the housing at each end, as by a flare.

The flare may desirably define at least one expansion slot and comprises at least one flare petal, each flare petal defining at least one of the engagement surface portions.

The tubular assembly may also desirably define means for preventing the flare from contacting the filter housing and for promoting expansion of the engagement surface portions into locking engagement with the hollow tube. In a preferred embodiment, the flare defines locking tab zones having locking tabs, the locking tabs underlying the flare for preventing the flare from contacting the filter housing except in the locking tab zones and for promoting expansion of the engagement surface portions into locking engagement with the hollow tube.

The locking tabs are configured to bend upward to promote expansion of the engagement surface portions into locking engagement with the hollow tube and to prevent the flare from contacting the filter housing.

In a preferred embodiment, the means receiving the mounting member comprises a neck formed in the flare. As the engagement surface portions expand, each flare petal deforms collapsing the neck against the mounting member.

In one embodiment, the mounting member comprises a threaded screw and the neck defines a threaded inner surface configured to engage the threaded screw. In another embodiment, the mounting member comprises an externally threaded mounting stud fixed to the housing in the cavity and a complementary threaded nut.

A method of making an RF filter assembly in accordance with the present invention comprises the steps of providing a filter housing defining a cavity; forming a hollow tube having an inner wall defining an interior of uniform diameter and having a circular base; forming a flare configured to fit within the interior, the flare having at least two spaced engagement surface portions for engaging the inner wall of the hollow tube; positioning the flare within the interior a predetermined distance from the base of the hollow tube with the flare engagement surface portions confronting the inner wall; and expanding the flare engagement surface portions into locking engagement with the inner wall of the hollow tube while drawing the circular base of the hollow tube into firm engagement with the filter housing.

The method desirably comprises forming at least two hollow tubes, at least one of which is a resonator and at least one of which is a decoupling rod, and forming flares which are configured to fit, respectively, in one end of a resonator and at both ends of the decoupling rod.

The step of forming a tuning rod desirably comprises cutting off a length of an elongated drawn hollow rod. The expanding step further comprises expanding the engagement surface portions into locking engagement with the inner wall a predetermined distance above the base of the hollow tube.

In a preferred embodiment, the flare is dish-shaped whereby during the step of expanding, the dish-shape tends to flatten thereby forcing the engagement surface portions into locking engagement with the inner wall. The flare is formed with at least one expansion slot and has at least one flare petal defining at least one of the engagement surface portions.

The flare may further be formed with locking tab zones having locking tabs underlying the flare for preventing the flare from contacting the filter housing except in the locking tab zones and for promoting expansion of the engagement surface portions into locking engagement with the inner wall of the hollow tube.

The method further comprises providing a mounting member for firmly locking the tuning rod assembly against the filter housing by expanding the flare engagement surface portions into locking engagement with the inner wall of the hollow tube while drawing the circular base of the hollow tube into firm engagement with the filter housing. The flare may further be formed with a neck for receiving the mounting member.

In these ways and others, cost effective RF filter assemblies can be manufactured having simple and easily mounted resonators and decoupling rods.

Further objects, features and advantages of the present invention will become apparent from the following description and drawings.

DETAILED DESCRIPTION

Figure 1:
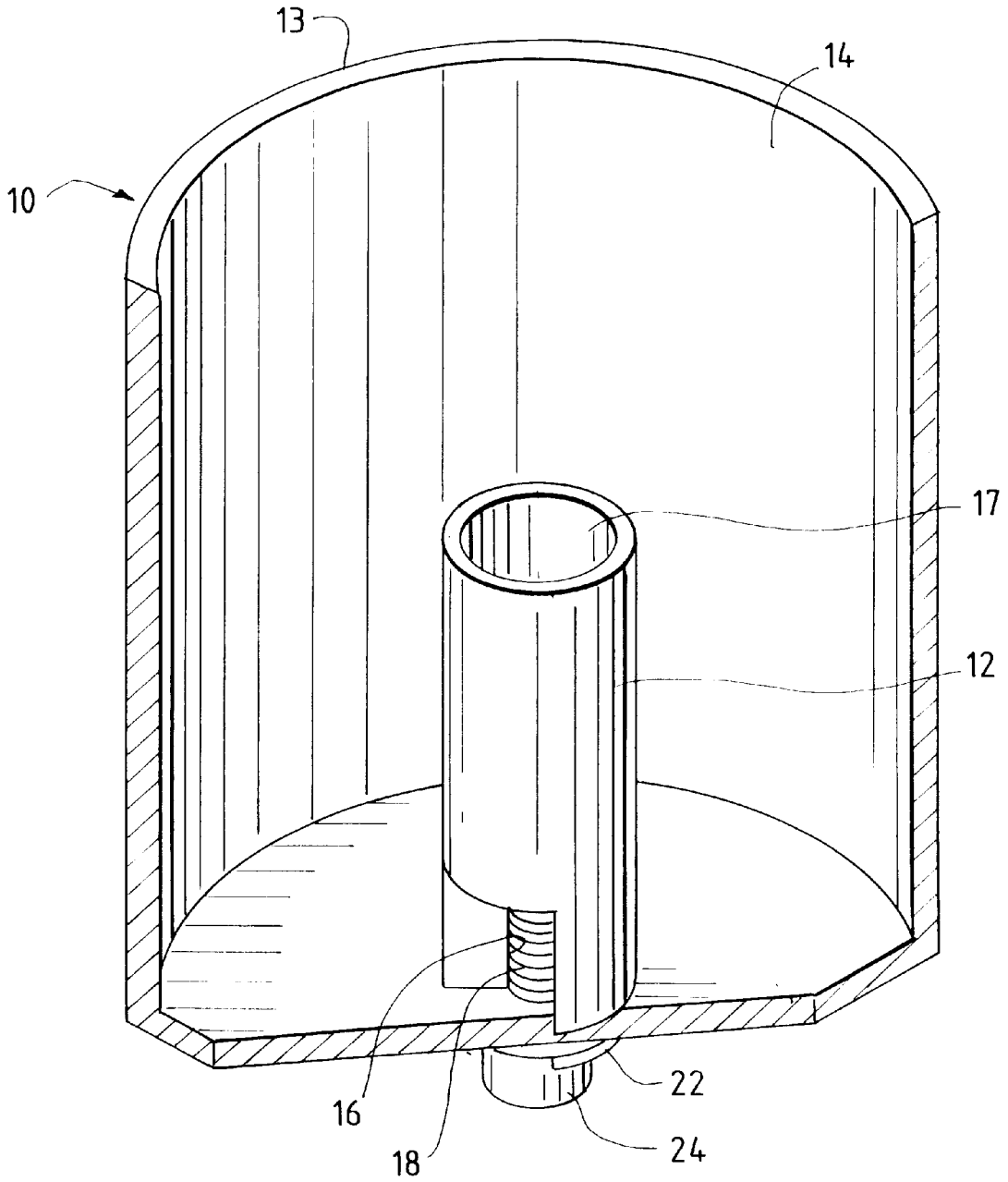
FIG. 1 PRIOR ART
FIG. 1 is a perspective view, partially in cross section, of a typical prior art RF filter assembly.

Referring first to the prior art drawing of FIG. 1, a conventional RF filter assembly 10 comprises a housing 13 defining a cavity 14 and a tubular resonator 12. Tubular resonator 12 is typically formed from a length of rod stock by drilling and tapping to provide a threaded opening 16 of a first diameter and a second internal diameter for the resonator section 17. The tubular resonator 12 is mounted in the cavity 14 via a threaded screw 18. Typically, a lock washer 22 is positioned between the screw head 24 and the filter housing 13 to minimize the likelihood of loosening.

Such filters require tubular resonators which are machined and fabricated at substantial expense. They also require lock washers to ensure their long term integrity.

Figure 2:
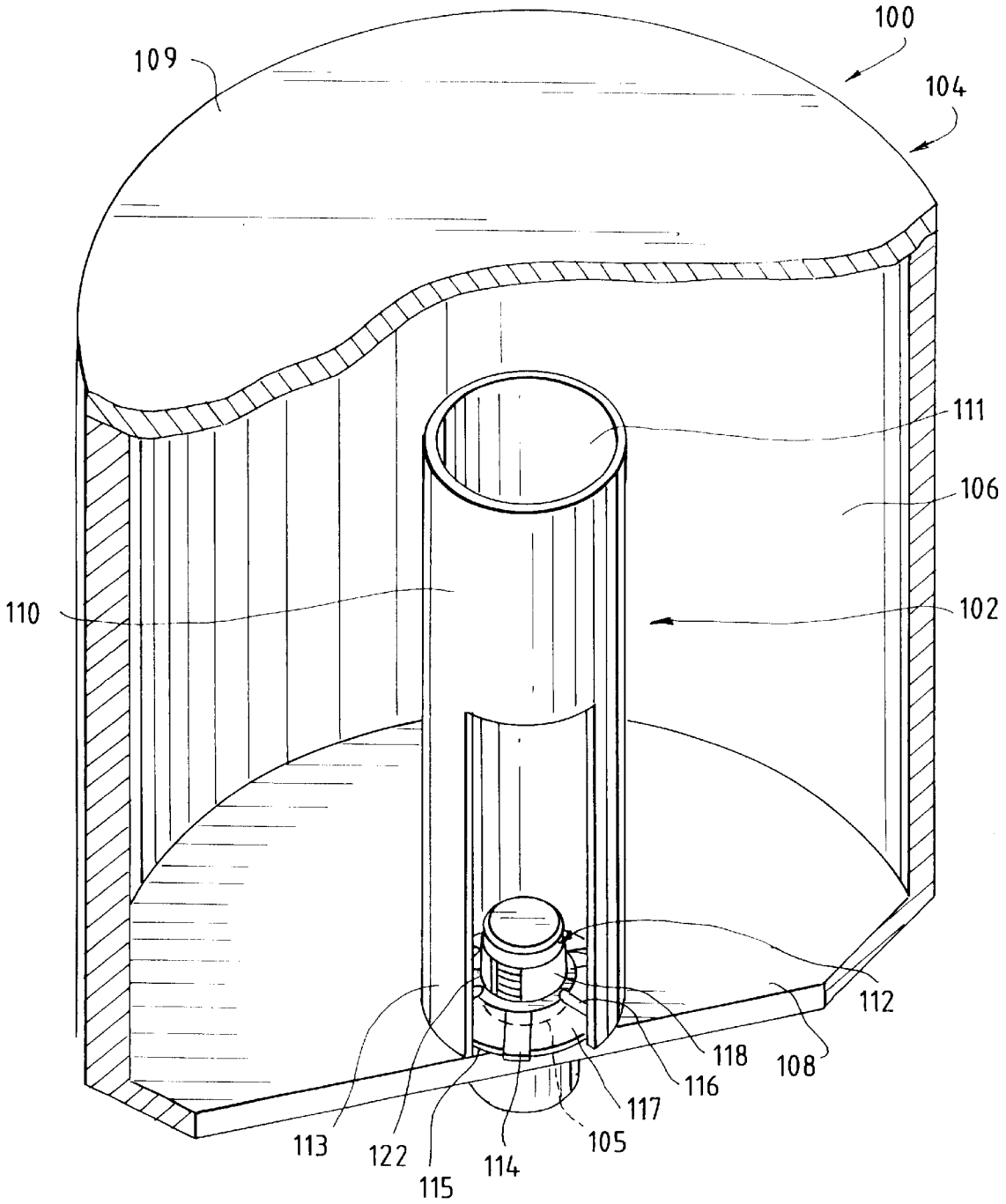
FIG. 2 is a perspective view, partially in cross section, of an RF filter assembly according to the present invention.
Figure 3:
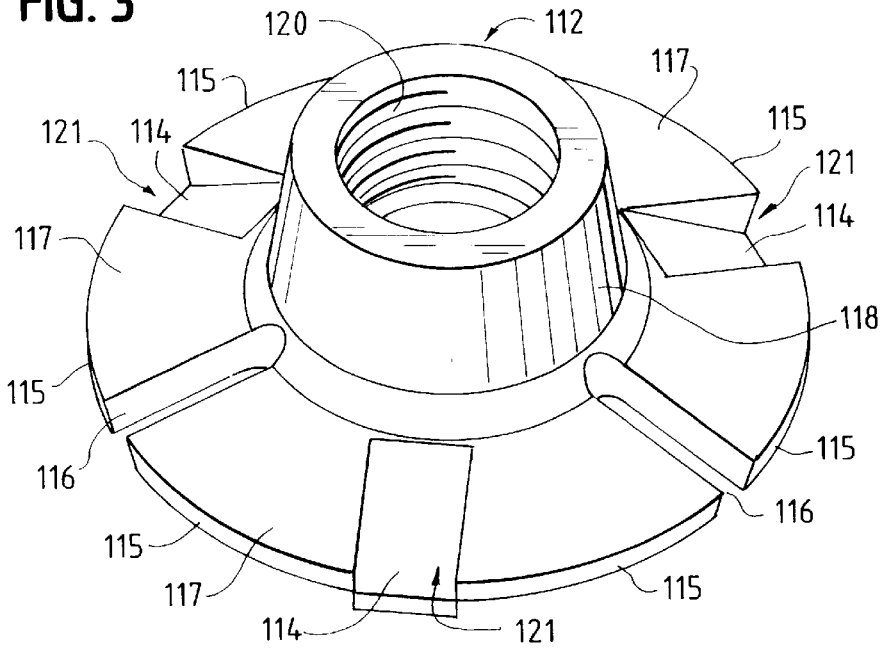
FIG. 3 is an enlarged perspective view of the flare of FIG. 2.

Referring now to FIGS. 2 and 3, an RF filter assembly 100 in accordance with the present invention is seen to comprise a filter housing 104, a tubular resonator assembly 102 and a mounting member, such as a threaded screw 122.

The filter housing 104 may be like the housing of prior art FIG. 1. Filter housing 104 defines a cavity 106 and has an integral floor 108 and a cover 109 which is removably secured thereto in a conventional manner, as by threaded screws. The center of the floor 108 defines an aperture 105 for receiving the threaded screw 122 for firmly locking the tubular resonator assembly 102 against the filter housing 104 in the cavity 106. The filter housing material is chosen based on the intended operating characteristics of the filter, and takes into consideration, among other things, the anticipated coefficient of expansion of the material. In a preferred embodiment, the filter housing 104 is fabricated from sheet metal, such as aluminum. Alternatively, the filter housing 104 may be die cast. The housing 104 may be of other metals, such as Invar, copper or stainless steel. If desirable, the filter housing may be silver plated to enhance its radio frequency properties.

The tubular resonator assembly 102 comprises a hollow tube 110 having an inner wall 111 defining an interior of uniform diameter and a circular base 113 and a flare 112 positioned within the interior of the hollow tube 110. The hollow tube 110 may be formed by cutting off a length of an elongated, drawn hollow rod. In many cases the rod may be standard tubing. Thus, the internal diameter (and external diameter) are essentially uniformly identical along the length of the hollow tube 110. Different tube materials can be used to accommodate the temperature coefficients of expansion and other requirements of the hollow tube 110. In a preferred embodiment, the hollow tube 110 is made of electrolytic copper. Alternatively, a stainless steel material may be used. The hollow tube 110 may also be silver plated to enhance its radio frequency properties.

The flare 112 has at least two spaced engagement surface portions 115 and has a central neck, such as a drawn neck 118, for receiving the threaded screw 122 such that when the tubular resonator assembly 102 is initially mounted in the cavity 106, the flare engagement surface portions 115 are expanded by the threaded screw 122 into locking engagement with the inner wall 111 of the hollow tube 110 and the circular base 113 of the hollow tube 110 is drawn into firm engagement with the filter housing 104.

As shown in FIG. 3, the preferred embodiment of the flare 112 is dish-shaped and has three flare petals 117 defining three expansion slots 116. Each flare petal 117 includes a locking tab zone 121 having a downwardly angled locking tab 114. The drawn neck 118 has a threaded inner surface 120 for receiving the threaded screw 122. The flare 112 is made of a copper alloy which is work hardened. The flare 112 may also be silver plated.

The tubular resonator assembly 102 is mounted in the cavity 106 by inserting the threaded screw 122 through the aperture 105 in the filter housing 104 and screwing the threaded screw 122 into the neck 118 thus expanding the engagement surface portions 115. As the dish-shaped flare 112 tends to flatten, the engagement surface portions 115 tend to expand outwardly. Each flare petal 117 tends to collapse the neck 118 inwardly against the threaded screw 122, thus locking the tubular resonator assembly 102 on the filter housing 104.

The locking tabs 114 are configured to bend upward to promote expansion of the engagement surface portions 115 into locking engagement with the hollow tube 110 and to prevent the main body of the flare 112 and the petals 117 from contacting the filter housing 104. It is also contemplated that a rubber O-ring underlying the petals 117 adjacent the inner wall 111 may be used in place of the locking tabs 114 to promote expansion of the engagement surface portions 115 and to prevent the flare 112 from coming into broad contact with the floor 108 of the filter housing 104.

Figure 4:
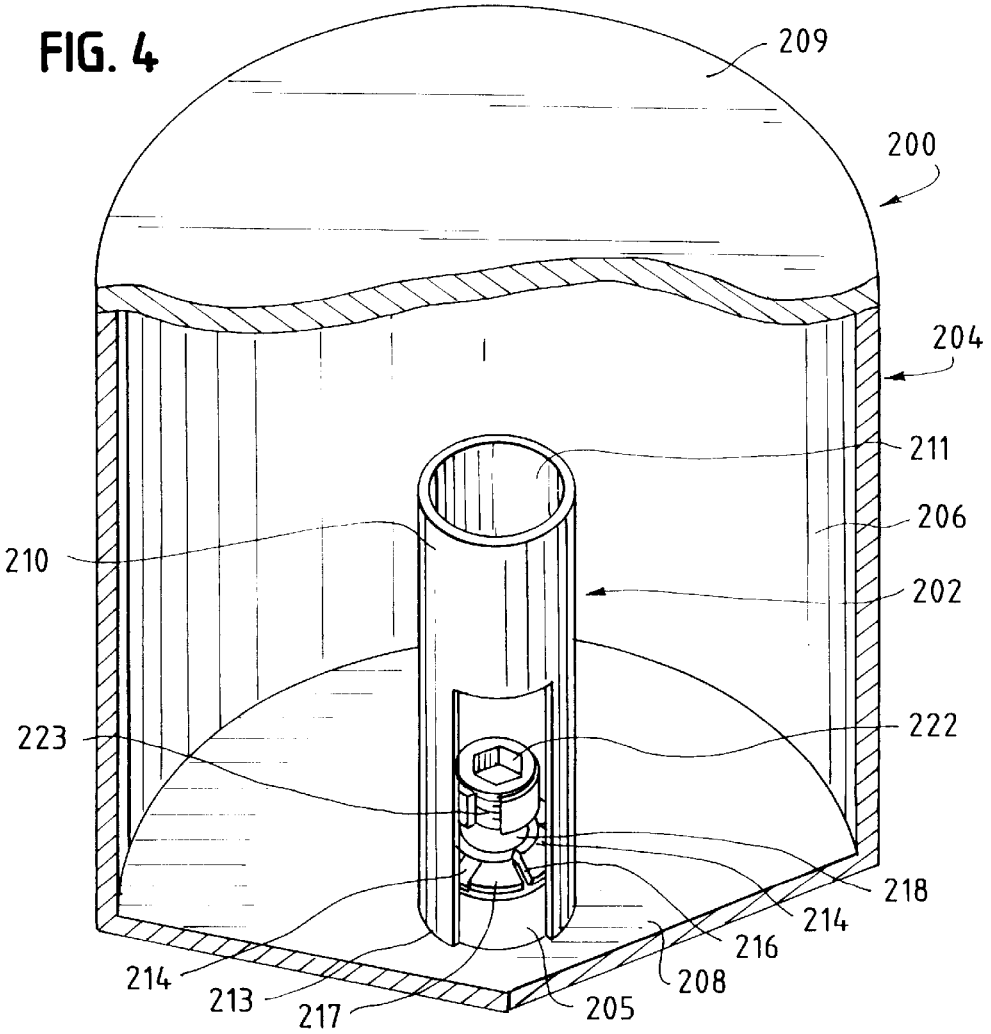
FIG. 4 is a perspective view, partially in cross section, of a further embodiment of an RF filter assembly according to the present invention.
Figure 5:
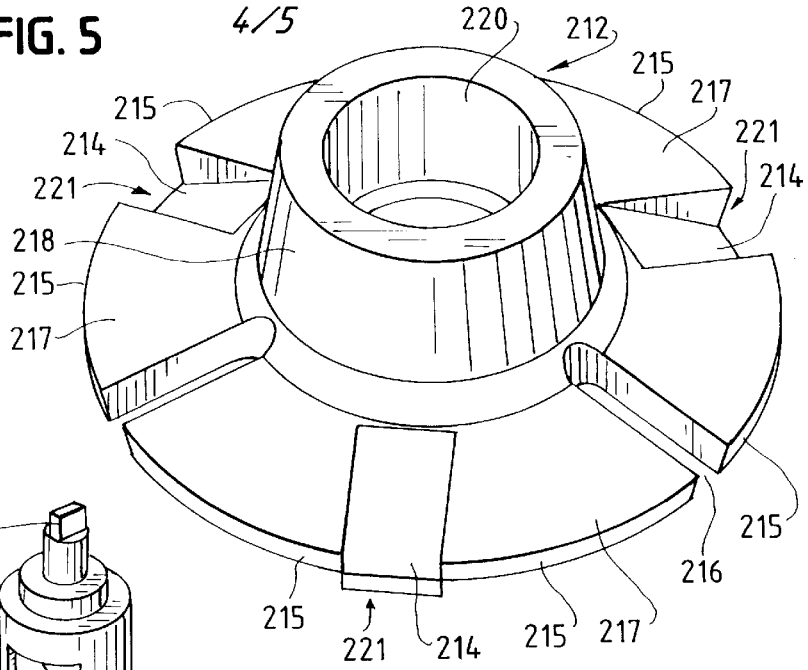
FIG. 5 is an enlarged perspective view of the flare of FIG. 4.

In another embodiment, shown in FIGS. 4 and 5, an RF filter assembly 200 comprises a tubular resonator assembly 202 similar to the one shown in FIG. 2 and a filter housing 204 defining a cavity 206 with a boss 205 having a threaded mounted stud 223 fixed to the filter housing 204, such as to the center of the filter housing floor 208 in the cavity 206. The boss 205 and mounting stud 223 are configured to project upwardly from the filter housing floor 208. A cover 209 is removably secured to the filter housing 204 in a conventional manner.

The tubular resonator assembly 202 comprises a hollow tube 210 having an inner wall 211 defining an interior of uniform diameter and having a circular base 213 and a flare 212 positioned within the interior of the hollow tube 210. As shown in FIG. 5, the flare 212 comprises a dish-shaped insert having three flare petals 217 defining three expansion slots 216 and a neck 218 for receiving the threaded mounting stud 223. Each flare petal 217 includes a locking tab zone 221 having a locking tab 214 like locking tabs 114.

Unlike the embodiment shown in FIG. 3, the inner surface 220 of the neck 218 of the flare 212 is not threaded. The threaded mounting stud 223 of the boss 205 is inserted through the neck 218 of the flare 212 and a threaded hex socket nut 222 is fastened to a threaded portion of stud 223 extending through the flare 212. The circular base 213 of the hollow tube 210 is seated on the floor 208 of the housing 204.

As the threaded nut 222 is screwed down on the threaded mounting stud 223, the flare petals 217 expand into firm engagement with the inner wall 111 of the hollow tube 210 and force the circular base 213 of the hollow tube 210 firmly against the filter housing floor 208. At this point, the locking tabs 214 of the flare 212 bear against the boss 205 and begin to bend upward causing the engagement surface portions 215 to expand. The expansion slots 216 allow the engagement surface portions 215 to expand to forceably engage the inner wall 211 of the hollow tube 210 and to cause the hollow tube 210 to firmly engage the filter housing 204.

Figure 7:
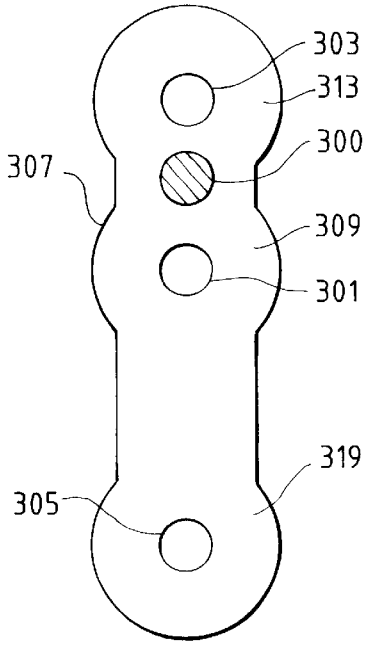
FIG. 7 is a top view, partially in a cross-section, of an RF filter assembly having tubular resonators and a decoupling rod.

As shown in FIG. 7, an RF filter assembly 100 can comprise multiple resonator hollow tubes 301, 303 and 305 in a single filter housing 307 having multiple filter cavities 309, 313 and 315. A decoupler 300 can be included in the RF filter assembly 100 to enhance decoupling between resonators. Decoupler 300 is placed between resonator hollow tubes 301 and 303 allowing resonator hollow tubes 301 and 303 to be placed closer together than resonator hollow tubes 301 and 305. Thus, the overall size of the RF filter assembly 100 can be reduced.

Figure 8:
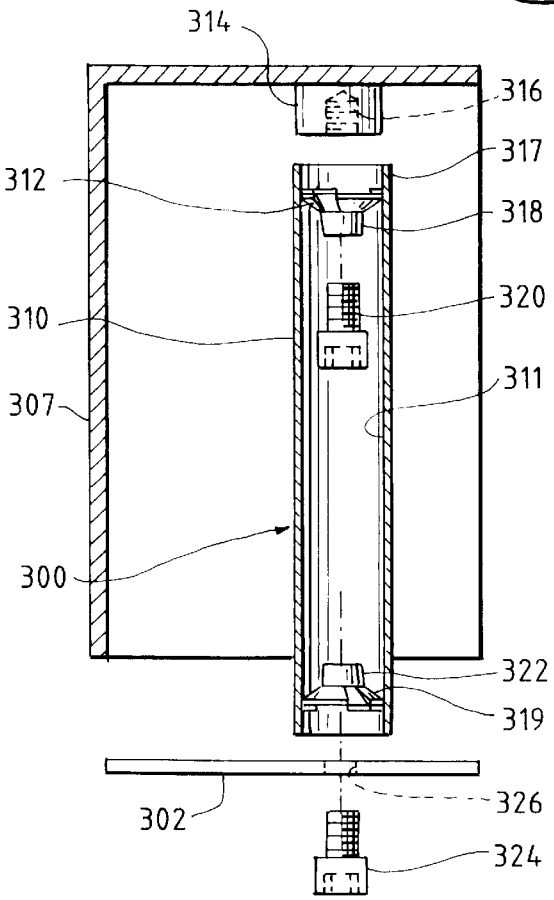
FIG. 8 is a side view, partially in cross-section, of the decoupling rod of FIG. 7.

Referring now to FIG. 8, coupler 300 comprises a hollow tube 310, like hollow tubes 110 and 210, having an inner wall 311 defining an interior of uniform diameter and circular ends 317 and 319, and two flares 312 and 321, like flares 212 and 112 respectively, positioned within the interior of the hollow tube 310. Coupler 300 is similar to the tubular resonator assemblies 102 and 202 illustrated in FIGS. 2 and 4. However, unlike tubular resonator assemblies 102 and 202 which are fixed at only one end, coupler 300 is fixed at both ends 317 and 319.

Hollow tube 310 is mounted to the filter housing 307 at one end 317 and to the filter cover 302 at the other end 319. Filter housing 307 includes a boss 314 having a threaded bore 316. Flare 312 has an unthreaded neck 318 similar to flare 212. Flare 312 is inserted into hollow tube 310 a predetermined distance from end 317. A threaded hex-top screw 320 is inserted through neck 318 into bore 316. Screw 320 is then screwed onto bore 316 causing flare 312 to expand into engagement with the inner wall 311 of hollow tube 310, forcing end 317 firmly against the filter housing 307 and locking hollow tube 310 in place in the manner described for the tubular resonator assemblies.

Next flare 321 is inserted into hollow tube 310 near end 319. Flare 321 has a threaded neck 322 similar to flare 112. The cover 302 is fixed to the filter housing 307 and a threaded mounting screw 324 is inserted through an aperture 326 in the cover 302 and into neck 322. The threaded mounting screw 324 is screwed into flare 321 causing flare 321 to expand into engagement with the inner wall 311 of hollow tube 310, forcing end 319 firmly against the filter cover 302 and locking hollow tube 310 in place in the manner described for the tubular resonator assemblies.

Figure 9:
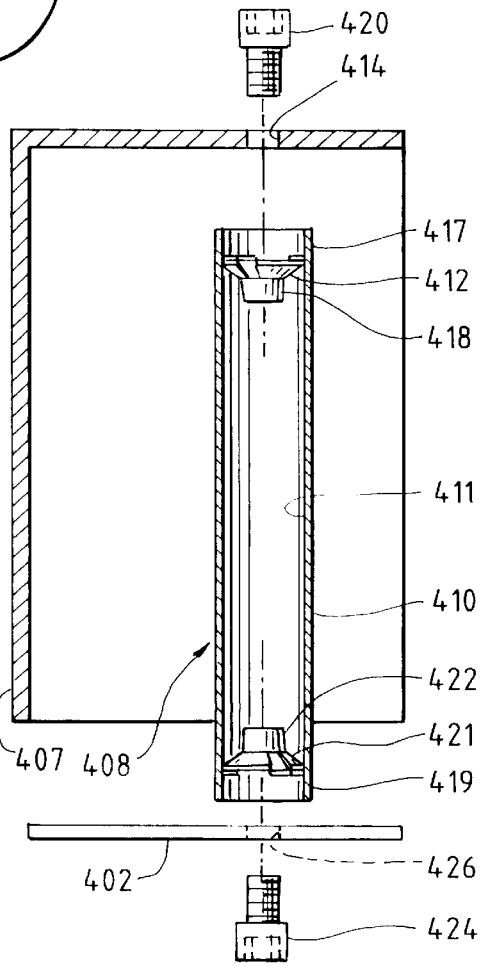
FIG. 9 is a side view, partially in cross-section, of a further embodiment of a decoupling rod of FIG. 7.

In another embodiment, shown in FIG. 9, a coupler 400 comprises a hollow tube 410, like hollow tubes 110, 210 and 310, having an inner wall 411 defining an interior of uniform diameter and circular ends 417 and 419, and two flares 412 and 421, like flare 112, positioned within the interior of the hollow tube 410. Hollow tube 410 is mounted to the filter housing 407 at one end 417 and to the filter cover 402 at the other end 419.

Filter housing 407 and filter cover 402 include apertures 414 and 426, respectively. Flares 412 and 421 have threaded necks 418 and 422, respectively, similar to flare 112. Flares 418 and 422 are inserted into hollow tube 410 a predetermined distance from ends 417 and 419, respectively. Threaded mounting screws 420 and 424 are inserted through apertures 414 and 426 into flares 412 and 421. The threaded mounting screws 420 and 424 are screwed into flares 412 and 421 causing the flares to expand into engagement with the inner wall 411 of the hollow tube 410, forcing ends 317 and 319 firmly against the filter housing 407 and filter cover 402, and locking hollow tube 410 in placed in the manner described for the tubular resonator assemblies.

The method of making the resonator filter assembly according to the present invention comprises providing a filter housing 104 defining a cavity 106. A resonator is formed and preferably comprises a hollow tube 110 having an inner wall 111 defining an interior of uniform diameter and having a circular base 113. A flare 112 is formed to fit within the interior of the hollow tube 110 at one end thereof, the flare 112 having at least two spaced engagement surface portions 115 for engaging the inner wall 111 of the hollow tube 110. The flare 112 is positioned within the interior of the hollow tube 110 a predetermined distance from the circular base 113 of the hollow tube 110 with the flare engagement surface portions 115 confronting the inner wall 111. The flare engagement surface portions 115 are expanded into locking engagement with the inner wall 111 of the hollow tube 110 while drawing the circular base 113 of the hollow tube 110 into firm engagement with the filter housing 104.

The hollow tube 110 may be formed by cutting off a length of an elongated drawn tubular hollow rod. The flare 112 is locked a predetermined distance above the circular base 113 of the hollow tube 110. In the embodiment shown in FIG. 3, the flare 112 is dish-shaped such that during the step of expanding, the dish-shape tends to flatten thereby forcing the engagement surface portions 115 into locking engagement with the inner wall 111.

Figure 6:
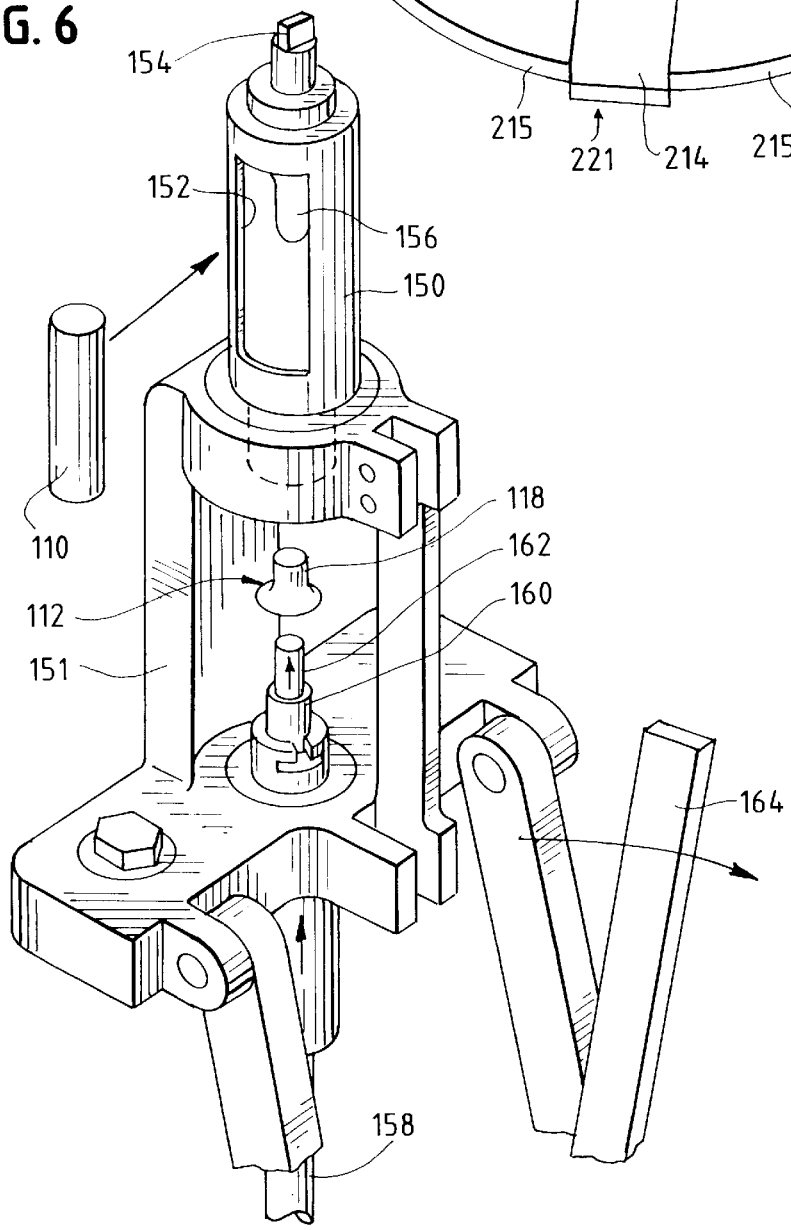
FIG. 6. is a perspective view of an assembly device for assembling a tubular assembly according to the present invention.

The resonator assembly 102 is assembled by inserting the flare 112 into the interior of the hollow tube 110. This is typically done by inserting the hollow tube 110 into an assembly die 150, shown in FIG. 6, such as a Rock Chucker press, where it is held during the inserting process. The assembly die 150 includes assembly die windows 152 for loading the hollow tube 110 into the assembly die 150. A support member 154 is provided for holding the hollow tube 110 in the assembly die 150. The assembly die 150 is held in place by a frame 151. The support member 154 comprises a steel plug in the top of assembly die 150. The support member 154 provides an elongated stem 156 which fits snugly inside the top of a hollow tube 110 holding the hollow tube 110 in place by friction.

An insertion tool 158 is used to insert the flare 112 into the hollow tube 110. The insertion tool 158 comprises a press flange 160 having an elongated stem 162 which is received by the neck 118 of the flare 112 thereby holding the flare 112 on the elongated stem 162. The press flange 160, holding a flare 112, is forced through the bottom of the assembly die 150 and into the hollow tube 110 by a lever handle 164. Typically, the hollow tube 110 is held in place inside the assembly die 150 by the assembly die operator with one hand until the insertion tool 158 and flare 112 engage the hollow tube 110 via operation of the tool by the operator's other hand.

Once the flare 112 is forced into place in the tuning rod 110, the press flange 160 is withdrawn from the assembly die 150, leaving the flare 112 inside the hollow tube 110. The resonator assembly 102 comprising the hollow tube 110 and inserted flare 112 is then removed from the support member 154 and assembly die 150 and is ready for assembly in the resonator filter assembly 100.

In the embodiment shown in FIGS. 2 and 3, a threaded mounting screw 122 is used to mount the resonator assembly 102 onto the filter housing 104. The threaded mounting screw 122 is inserted through the aperture 105 in the filter housing floor 108 and into the neck 118 of the flare 112. The threads of the threaded mounting screw 122 engage the threaded inner surface 120 of the neck 118.

As the threaded mounting screw 122 is screwed into place, the flare 112 draws the resonator assembly 102 down until the bottom edge of the hollow tube 110 engages the filter housing floor 108. At this point, the locking tabs 114 of the flare 112 engage the floor and begin to bend upwardly, causing the engagement surface portions 115 of the petals 117 to expand. The expansion slots 116 allow the engagement surface portions to expand to engage the inner wall 111 of the hollow tube 110 to further secure the flare 112 in the hollow tube 110.

The hollow tube 110 is continually drawn down with an extremely high force against the filter housing floor 108 holding the hollow tube 110 in tight engagement with the filter housing floor 108. The locking tabs 114 are configured to deform, so as not to affect the resultant force between the hollow tube 110 and the filter housing floor 108.

The expansion of the engagement surface portions 115 causes a deformation of the flare petals 117 acting to force the neck 118 of the flare 112 against the threaded mounting screw 122, effectively locking resonator assembly 102 to the filter housing 104.

In the embodiment shown in FIGS. 4 and 5, the resonator 202 is assembled by inserting the flare 212 into the interior of the hollow tube 210 as described previously. In this embodiment, the flare 212 is positioned a predetermined distance from the circular base 213 of the hollow tube 210 to accommodate the boss 205 beneath the flare 212 inside the hollow tube 210. When in position inside the hollow tube 210, the locking tabs 214 of the flare 212 engage the inner wall 211 of the hollow tube 210. The assembled resonator assembly 202 is then mounted onto the filter housing 204 and is firmly seated in the manner described above.

In the embodiments shown in FIGS. 8 and 9, the couplers are also assembled by inserting flares into the interiors of the hollow tubes as described for the tubular resonator assemblies.

From the foregoing, it will be apparent to those of ordinary skill in the art that modifications may be made without departing from the spirit and scope of the invention. Accordingly, the present invention is not intended to be limited except as may be necessary in view of the appended claims.

What is claimed is:

1. A tubular assembly for use in an RF filter assembly having a cavity defined by a filter housing, said tubular assembly being mountable in said housing via a mounting member, the tubular assembly comprising:

a hollow tube having an inner wall defining an interior of uniform diameter and having a circular base; and a flare positioned within the interior of said hollow tube, said flare having at least two spaced engagement surface portions and having means for receiving a said mounting member such that when said tubular assembly is initially mounted in a said housing the engagement surface portions are expanded by a said mounting member into locking engagement with the inner wall of said hollow tube such that the circular base of the hollow tube may be drawn into firm engagement with a said filter housing.

2. The tubular assembly of claim 1, and wherein said hollow tube is a resonator for mounting in a cavity defined by said housing.

3. The tubular assembly of claim 1, and wherein said hollow tube is a decoupler and a said flare is positioned within each end of said hollow tube.

4. The tubular assembly of claim 1 wherein said flare further defines at least one expansion slot and comprises at least one flare petal, each said flare petal defining at least one of said engagement surface portions.

5. The tubular assembly of claim 4 wherein said means for receiving a said mounting member comprises a neck formed in said flare and wherein as said engagement surface portions expand, each said flare petal deforms collapsing said neck against a said mounting member.

6. The tubular assembly of claim 5 wherein said neck defines a threaded inner surface configured to engage a said mounting member which is threaded.

7. The tubular assembly of claim 1 wherein said tubular assembly defines means for preventing said flare from contacting a said filter housing and for promoting expansion of said engagement surface portions into locking engagement with said hollow tube.

8. The tubular assembly of claim 1 wherein said flare defines locking tab zones having locking tabs, said locking tabs underlying the flare for preventing said flare from contacting a said filter housing except in the locking tab zones and for promoting expansion of said engagement surface portions into locking engagement with said hollow tube.

9. The tubular assembly of claim 8 wherein said locking tabs are configured to bend upward to promote expansion of said engagement surface portions into locking engagement with said hollow tube and to prevent said flare from contacting a said filter housing.

10. A flare insertable into a rod comprising a hollow tube having an inner wall defining an interior of uniform diameter, said flare being adapted to mount a said hollow tube in an RF filter housing using a cooperating mounting member, the flare comprising;

at least two engagement surface portions; and means for receiving a said mounting member;

wherein said engagement surface portions are expandable by a said mounting member to cause said engagement surface portions to engage a said inner wall of a said hollow tube locking the flare in a said hollow tube.

11. The flare of claim 10 wherein the flare further defines at least one expansion slot and comprises at least one flare petal, each said flare petal defining at least one of said engagement surface portions.

12. The flare of claim 11 wherein said means for receiving a said mounting member comprises a neck formed in the flare and wherein as said engagement surface portions expand, each said flare petal deforms collapsing said neck against a said mounting member.

13. The flare of claim 12 wherein said neck defines a threaded inner surface configured to engage a said mounting member which is threaded.

14. The flare of claim 10 wherein said flare defines locking tab zones having locking tabs, said locking tabs underlying the flare for preventing said flare from contacting a said filter housing except in the locking tab zones and for promoting expansion of said engagement surface portions into locking engagement with a said hollow tube.

15. The flare of claim 14 wherein said locking tabs are configured to bend upward to promote expansion of said engagement surface portions into locking engagement with a said hollow tube and to prevent said flare from contacting a said RF filter housing.

16. An RF filter assembly comprising:

a filter housing defining a cavity;

a tubular assembly mounted in said housing; and a mounting member for firmly locking said tubular assembly against said housing;

wherein the tubular assembly comprises:

at least one hollow tube having an inner wall defining an interior of uniform diameter and having a circular base; and a flare positioned within the interior of said hollow tube, said flare having at least two spaced engagement surface portions and having means receiving said mounting member such that when said tubular assembly is initially mounted in said housing, the flare engagement surface portions are expanded by said mounting member into locking engagement with the inner wall of said hollow tube and the circular base of the hollow tube is drawn into firm engagement with said filter housing.

17. An RF filter assembly in accordance with claim 16, and wherein a said hollow tube comprises a resonator mounted at one end in a cavity in said housing.

18. An RF filter assembly in accordance with claim 16, and wherein a said hollow tube comprises a decoupling rod locked by a flare at each end with the filter housing.

19. The RF filter assembly of claim 16 wherein said flare further defines at least one expansion slot and comprises at least one flare petal, each said flare petal defining at least one of said engagement surface portions.

20. The RF filter assembly of claim 19 wherein said means receiving said mounting member comprises a neck formed in said flare and wherein as said engagement surface portions expand, each said flare petal deforms collapsing said neck against said mounting member.

21. The RF filter assembly of claim 20 wherein said mounting member comprises a threaded screw and said neck defines a threaded inner surface configured to engage said threaded screw.

22. The RF filter assembly of claim 16 wherein said flare defines locking tab zones having locking tabs, said locking tabs underlying the flare for preventing said flare from contacting said filter housing except in the locking tab zones and for promoting expansion of said engagement surface portions into locking engagement with said hollow tube.

23. The RF filter assembly of claim 22 wherein said locking tabs are configured to bend upward to promote expansion of said engagement surface portions into locking engagement with said hollow tube and to prevent said flare from contacting said filter housing.

24. The RF filter assembly of claim 16 wherein said mounting member comprises an externally threaded mounting stud fixed to said housing in said cavity and a complementary threaded nut.

25. The RF filter assembly of claim 16 wherein said tubular assembly defines means for preventing said flare from contacting said filter housing and for promoting expansion of said engagement surface portions into locking engagement with said hollow tube.

26. A method of making an RF filter, the method comprising the steps of:

providing a filter housing defining a cavity;

forming a hollow tube having an inner wall defining an interior of uniform diameter and having a circular base;

forming a flare configured to fit within said interior, said flare having at least two spaced engagement surface portions for engaging said inner wall of said hollow tube;

positioning said flare within said interior a predetermined distance from the base of said hollow tube with said flare engagement surface portions confronting said inner wall;

expanding said flare engagement surface portions into locking engagement with said inner wall of said hollow tube while drawing said circular base of said hollow tube into firm engagement with said filter housing.

27. The method of claim 26, and wherein said method comprises forming at least two hollow tubes, at least one as a resonator and at least one as a decoupling rod, and forming flares which are configured to fit, respectively, in one end of said resonator and at both ends of said decoupling rod.

28. The method of claim 26 wherein the step of forming a hollow tube comprises cutting off a length of an elongated drawn hollow rod.

29. The method of claim 26 wherein said expanding step further comprises expanding said engagement surface portions into locking engagement with said inner wall a predetermined distance above the base of said hollow tube.

30. The method of claim 26 wherein said flare is dish-shaped whereby during said step of expanding, said dish-shape tends to flatten thereby forcing said engagement surface portions into locking engagement with said inner wall.

31. The method of claim 26 wherein said flare is formed with at least one expansion slot and has at least one flare petal defining at least one of said engagement surface portions.

32. The method of claim 26 wherein said flare is further formed with locking tab zones having locking tabs underlying said flare for preventing said flare from contacting the filter housing except in the locking tab zones and for promoting expansion of said engagement surface portions into locking engagement with the inner wall of a said hollow tube.

33. The method of claim 26 further comprising providing a mounting member for firmly locking said hollow tube against said filter housing by expanding the flare engagement surface portions into locking engagement with said inner wall of said hollow tube while drawing said circular base of said hollow tube into firm engagement with said filter housing.

34. The method of claim 33 wherein said flare is further formed with a neck for receiving the mounting member.

* * * * *